US006877500B1

(12) United States Patent
Hollars et al.

(10) Patent No.: US 6,877,500 B1
(45) Date of Patent: Apr. 12, 2005

(54) ARCHERY ARROW ROTATION PRIOR TO SEPARATION FROM BOW

(76) Inventors: Anthony Scott Hollars, 6445 W. Lost Canyon Dr., Tucson, AZ (US) 85745; Jon Marc Edwards, 4619 S. Lake Mary Rd., Apt. 1, Flagstaff, AZ (US) 86001

( * ) Notice: Subject to any disclaimer, the term of this patent is extended or adjusted under 35 U.S.C. 154(b) by 0 days.

(21) Appl. No.: 10/374,196

(22) Filed: Feb. 26, 2003

Related U.S. Application Data

(60) Provisional application No. 60/359,803, filed on Feb. 26, 2002.

(51) Int. Cl.[7] ..... F41B 5/00
(52) U.S. Cl. ..... 124/24.1; 124/86
(58) Field of Search ..... 124/23.1, 24.1, 124/25.6, 86, 90, 91, 89

(56) References Cited

U.S. PATENT DOCUMENTS 2,125,591 A * 8/1938 Smith ..... 124/24.1
4,027,645 A * 6/1977 Damron ..... 124/24.1
4,829,974 A * 5/1989 Anderson ..... 124/24.1
5,311,855 A * 5/1994 Basik ..... 124/44.5
5,971,875 A * 10/1999 Hill ..... 473/578
6,478,700 B2 * 11/2002 Hartman ..... 473/578
6,595,880 B2 * 7/2003 Becker ..... 473/578

* cited by examiner

*Primary Examiner*—John A. Ricci
(74) *Attorney, Agent, or Firm*—J Marc Edwards

(57) ABSTRACT

The arrow rotation device of the present invention substantially reduces the described disadvantages of prior art arrow rotation systems by inducing a rotation on the arrow shaft prior to leaving the bow and entering free flight. It is an object of the present invention to provide a means for inducing a rotational velocity about the longitudinal axis of an arrow as it travels through the bow over the releasing range. It is another object of this invention to provide an arrow rotating system that can be used with existing archery bows with minimal modifications or available as a factory option (OE). It is a further object of the present invention to provide a means for mechanically inducing a rotational velocity about the longitudinal axis of an arrow through a constant or a variable rotational acceleration to achieve a desired rotational velocity prior to separation of an arrow from the bow.

9 Claims, 11 Drawing Sheets

ARCHERY ARROW ROTATION PRIOR TO SEPARATION FROM BOW

This application claims benefit of Provisional Application Ser. No. 60/359,803, filed Feb. 26, 2002.

FEDERALLY SPONSORED RESEARCH

Not Applicable

SEQUENCE LISTING OR PROGRAM

Not Applicable

TECHNICAL FIELD

This invention relates to archery bows or crossbows, particularly a mechanical means to generate arrow shaft rotation about the longitudinal axis prior to leaving the bow upon bowstring release by an archer, thus providing increased stability, distance and improved flight accuracy of the arrow.

BACKGROUND ART

Conventional archery methods of inducing arrow shaft rotation about the longitudinal spin axis primarily use variations of fletching or vanes. Launching an arrow into free flight upon release of the bowstring, air passing across fletching mounted with an angular offset to the longitudinal axis of the arrow, induces a torque about the longitudinal axis of an arrow. The net result is arrow rotation only after the arrow has traveled some distance. Features common to conventional methods require the arrow to be moving through a fluid to create the desired rotational forces. During the first moments of free flight, a current art bow launches an arrow that is not rotating about the longitudinal axis. The negative effects of zero initial rotational velocity about the longitudinal spin axis upon launch make an arrow more prone to deviate from the intended flight path. The energy required to rotationally accelerate the arrow shaft caused by prior art fletching drag robs valuable forward velocity through all phases of flight. The benefit of the physics governing conservation of angular momentum, incurred by rotation about the arrow shaft longitudinal axis, that minimize the influences of external forces, do not come into play until the arrow shaft is actually rotating. Thus, immediately upon entry into free flight, a conventional arrow loses the benefit of increased stability created by conservation of angular momentum forces until the arrow has traveled some distance.

The size of conventional fletching required to provide enough surface area necessary to get a free flight arrow rotating in a short period of time must be substantial. Once the arrow is sufficiently rotating at a latter position in the flight path, substantial fletching now causes unnecessary drag on the rotating arrow. The net result is a shorter and more parabolic flight trajectory. Additionally, fletching acts to steer an arrow into a crosswind.

In an effort to increase rotation of the arrow, known prior art devices attach vanes to the arrow shaft in a helical orientation with respect to the longitudinal axis of the arrow shaft. The helical orientation of the archery vanes generates more rotation during flight than other conventional archery vanes. However, due to the decreased clearance between archery vanes, the archery vanes interfere with an arrow rest of a bow, for example as an archer launches the arrow. This interference causes the arrow to change direction when fired from the bow or wobble during flight, resulting in decreased accuracy and flight distance. Additionally, arrow nock points require alignment or timing thus incurring an additional set-up procedure prior to launching an arrow. Further, because of a required offset position, arrows having helically oriented archery vanes are difficult to manufacture and create greater aerodynamic drag during flight.

Other conventional archery vanes have a surface with a convex shape producing an airfoil-type archery vane to generate rotation. However, the convex surface produces only a small amount of fluid displacement and relatively little rotation of the arrow during flight. Thus, these conventional archery vanes do not provide the desired rotation and stability to the arrow.

Either conventional or in the present invention, energy is required to spin an arrow. The present invention has the advantage of initially exerting energy to spin the arrow mechanically over the releasing range and thus minimizes external forces the entire period of flight, most importantly, during the first moments of free flight. The smallest deviation from intended flight path at the beginning of flight continues to grow in error as flight distance and flight time increase. A common analogy is rifling (machined spirals) located in the inner barrel bores of most guns, old and modern. Rifling acts to spin a projectile (or projectiles when referring to a shotgun) upon firing. Bullets from guns leave the barrel already spinning. No known prior art archery bows launch a pre-spinning arrow. Bullets and arrows are both projectiles with an intended flight path fighting dynamic external forces that include gravity and fluids. The disadvantage of waiting for an arrow to be moving through a fluid to create the desired rotational forces simply allows more time for introduced influential errors in the first moments of free flight.

There is an apparent need for an archery bow device that upon launch generates rotation of the arrow shaft about the longitudinal axis prior to the arrow leaving the bow thus providing increased arrow stability and flight accuracy.

SUMMARY OF THE INVENTION

It is an object of the present invention to provide a means for inducing a rotational velocity about the longitudinal axis of an arrow as it travels through the bow over the releasing range.

It is another object of this invention to provide an arrow rotating system that can be used with existing archery bows with minimal modifications or available as a factory option (OE).

It is a further object of the present invention to provide a means for mechanically inducing a rotational velocity about the longitudinal axis of an arrow through a constant or a variable rotational acceleration to achieve a desired rotational velocity prior to separation of an arrow from the bow.

Another object of the present invention, because an arrow is entering free flight with a mechanically induced spin, fletching can be smaller than on conventional arrows. With the present invention, fletching would primarily serve to maintain rotational velocity rather than induce it. Ultimately, the smaller fletching would cause substantially less aerodynamic drag on an arrow through all ranges of flight. Additionally, small fletching would provide less cross-sectional surface area for an arrow launched into a crosswind. The result, less deviation from intended flight path.

It is a further object of the present invention to eliminate fletching completely. Utilizing the arrow rotation device for archery bows, test firings have been predictably accurate utilizing no fletching. Additional benefits realized utilizing no fletching are increased flight distances and flatter trajectories. Another advantage of the present invention is increased downrange velocity resulting in increased impact energy.

In one embodiment of the present invention, a diametrically opposed helically slotted spin tube mounts rigidly to the bow oriented such that an arrow fits inside the tube. Following the outer diameter of the spin tube is a nock drive collar or collar. The function of the nock drive collar is to ride on the outer diameter of the spin tube. Additionally, the nock drive collar captures the bowstring. Contained within the collar is a nock pin. The nock pin freely radially rotates while remaining captured within the nock drive collar. Pin rotation is urged as the collar translates along the spin tube. The nock pin follows the diametrically opposed, helical slots. By having an arrow nock in contact with the rotating nock pin contained within the nock drive collar installed on the spin tube, the arrow rotates in reverse upon draw and more importantly, upon release. Bow tuning becomes simpler because the guide tube now determines bowstring nock point. Mounting is possible with existing archery equipment incurring no permanent modifications. As an example, a tube bracket mounts to the same location on a riser as an arrow rest. This will become apparent from a consideration of the drawings and ensuing description. Alternatively, a riser can incorporate a spin-tube in an integrated, designed-in fashion.

In another embodiment of the present invention, a tube mounts to the riser of a bow. The tube has an inner diameter that allows clearance for an arrow. Diametrically opposed slots run along the major axis of the tube, oriented at the top most and bottom most parts of the tube. A bowstring runs through the opposed slots. On the inside of the tube are helical grooves or ridges that resemble rifling on a firearm barrel. An internal nock drive collar runs along the inside of the tube and attaches to the bowstring. Part of the internal nock drive collar contacts the bowstring and purely translates within the slotted tube upon bowstring draw and release. Another part of the nock drive collar that has the nock drive pin, translates in conjunction with the rest of the collar but rotation also occurs. Rotation is urged by part of the internal nock drive collar mechanically following the tube internal grooves or ridges. The arrow nock connects with the rotating component of the nock drive collar effectively rotating the arrow upon release (and draw) by an archer. Additionally, bow tuning becomes simpler because the guide tube now determines bowstring nock point.

In another embodiment of the present invention, mechanical arrow rotation is urged through physical contact with a plurality of deformable contact wheel arrow shaft rotators. As an archer releases the bowstring and arrow accelerates through the bow, the contact wheels roll about their axles while in contact with the arrow shaft. Additionally, inherent slip between the contact wheels and arrow shaft is likely to occur. Intentional contact wheel angular misalignment allows contact wheels to rotate in relation to a translating arrow shaft, yet slightly grip the arrow shaft to induce rotation as well. The contacting wheels can be of varied durometer materials or a combination of durometers within the same wheel. Angular adjustability for the contact wheels needs to be flexible. Flexibility includes differing from the arrow longitudinal axis as well as allowing for variances in arrow shaft diameters. Spring-loaded wheels are one preferred method to ease arrow insertion and allow tuning flexibility.

In a further embodiment, the present invention modifies an arrow shaft to accomplish the same result. Straight or spiral grooves running along the arrow major axis pass through or along contacting guides mechanically inducing arrow shaft rotation about the longitudinal axis as an archer releases the bowstring. Alternatively, straight or spiral ridges running along the arrow major axis pass through or along contacting guides. Either a freely rotating nock drive collar attaches at the nock point of the bowstring or the arrow nock must freely rotate in relationship to the arrow shaft because the nock cannot rotate while engaged with the bowstring. An additional advantage to helically oriented grooves or ridges running at least part way along an arrow longitudinal axis allow aerodynamic benefits. The double duty of the helical design initially gets the arrow rotating prior to free flight by following the contacting guides and second, aerodynamically performs the same function as fletching once in free flight to maintain the rotation.

Adapting and combining one or more of the mechanical arrow rotation methods, multiple "hybrid" combinations can be combined to achieve desired arrow rotation prior to arrow separation from bow upon bowstring release by an archer. dr

BRIEF DESCRIPTION OF THE DRAWINGS

Further aspects of the invention and their advantages are discernable from reading the following detailed description when taken in conjunction with the drawings in which.

DESCRIPTION OF INVENTION

The arrow rotation device of the present invention substantially reduces the described disadvantages of prior art arrow rotation systems by inducing a rotation on the arrow shaft prior to leaving the bow and entering free flight. Accuracy improves because unwanted influential forces can be overwhelmed by beneficial conservation of angular momentum forces by causing the arrow to rotate before leaving the bow. Because fletching can be eliminated or downsized, other resultant advantages follow. Improved trajectory due to reduced drag, reduced influence due to cross winds, better down range velocity, and impact force, are among the more substantial improvements.

Figure 1:
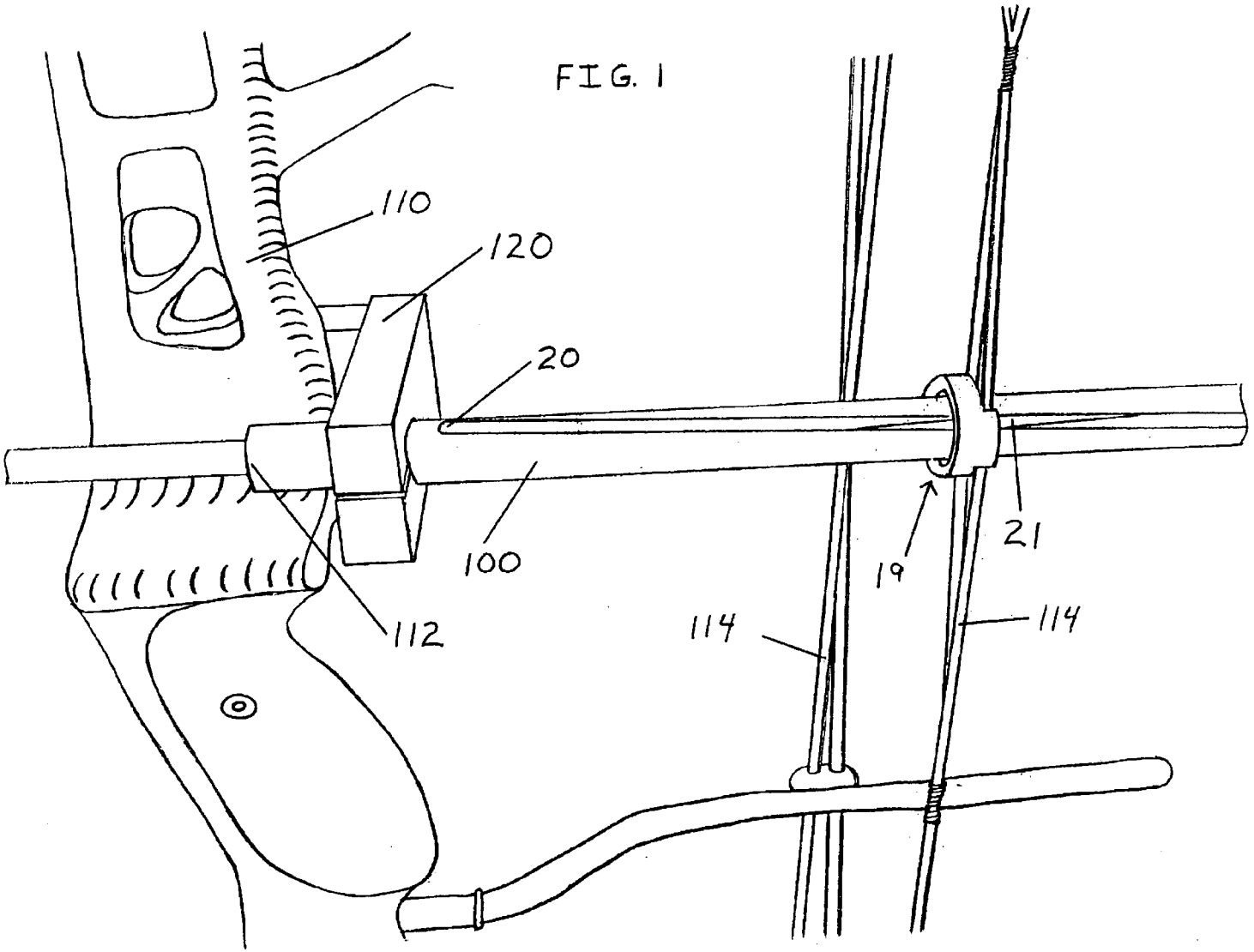
FIG. 1 is a left side isometric view of the helically slotted, diametrically opposed spin tube arrow rotation device, or spin tube, mounted to the riser of an archery bow with an arrow protruding out the front of the spin tube.
Figure 7:
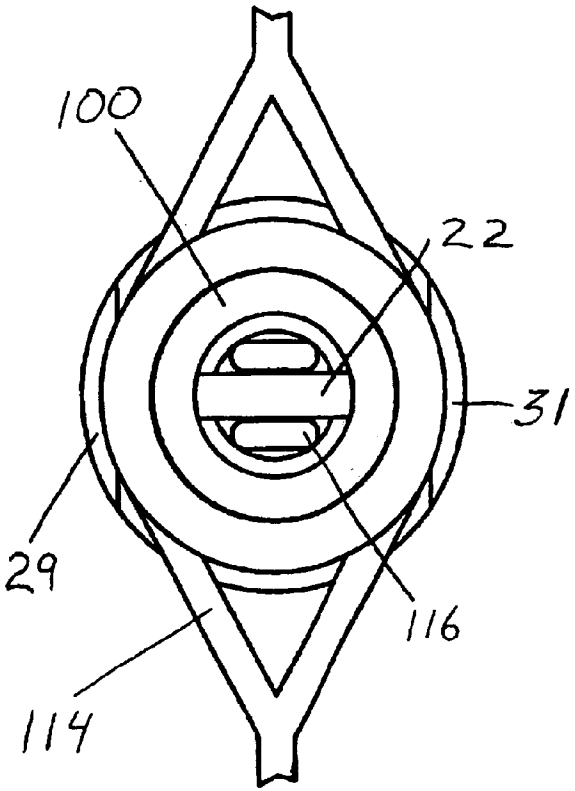
FIG. 7 is a rear view of the helically slotted, diametrically opposed nock drive collar assembly mounted on spin tube, detailing captured bowstring and arrow nock engaged with rotatable nock pin.
Figure 6:
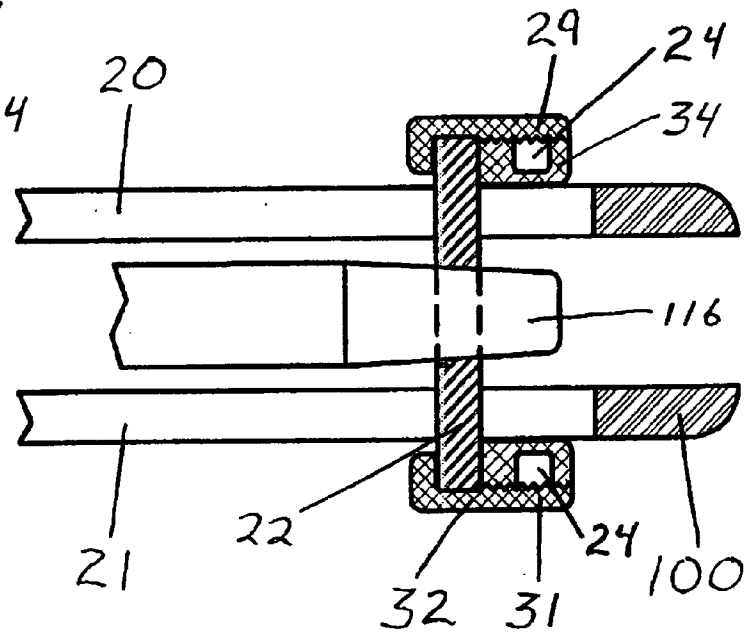
FIG. 6 is a cut-away side view of the nock drive collar assembly with rotating nock pin vertically oriented in the helical slots, installed on a cut-away side view of the spin tube. Note: arrow nock shown engaged with rotating nock pin.
Figure 5:
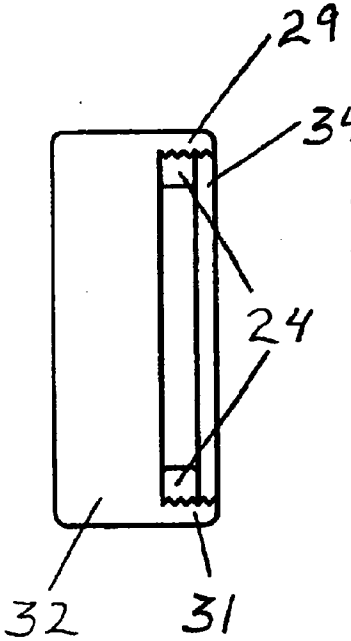
FIG. 5 is a side view of the nock drive collar assembly, one component of the helically slotted, diametrically opposed spin tube arrow rotation device.

FIG. 1 is a perspective view of the diametrically opposed, helically slotted spin tube arrow rotation device for archery bow. By utilizing the existing standardized arrow rest mounting point commonly located on the riser of bows, the arrow rotation device is easily adaptable to any existing bow. A spin tube-to-riser mount 120, rigidly attaches to the bow riser 110 and in turn, rigidly holds the diametrically opposed, helically slotted spin tube or spin tube 100. The front end 112 of spin tube 100 is circumferentially solid enabling spin tube-to-riser mount 120 to frictionally pinch spin tube 100. Additionally, spin tube 100 has two diametrically opposed, helical slots 20,21 running the release range distance of spin tube 100 major axis. A novel feature of helical slots 20,21 is that they effectively follow a helical path along the spin tube 100 major axis. Helical slot pitch resembles a similar pitch angle found on fletching of prior art arrows. An external nock drive collar assembly 19 freely translates along the outside of spin tube 100 major axis. Captured within the aft end of the external nock drive collar assembly 19 is the bowstring 114. An elaboration of the nock drive collar assembly 19 is detailed later in FIGS. 3, 4, 5, 6, 7. Additionally, shown in FIGS. 6, 7 is the interface of arrow nock 116 to nock drive pin 22.

Figure 2:
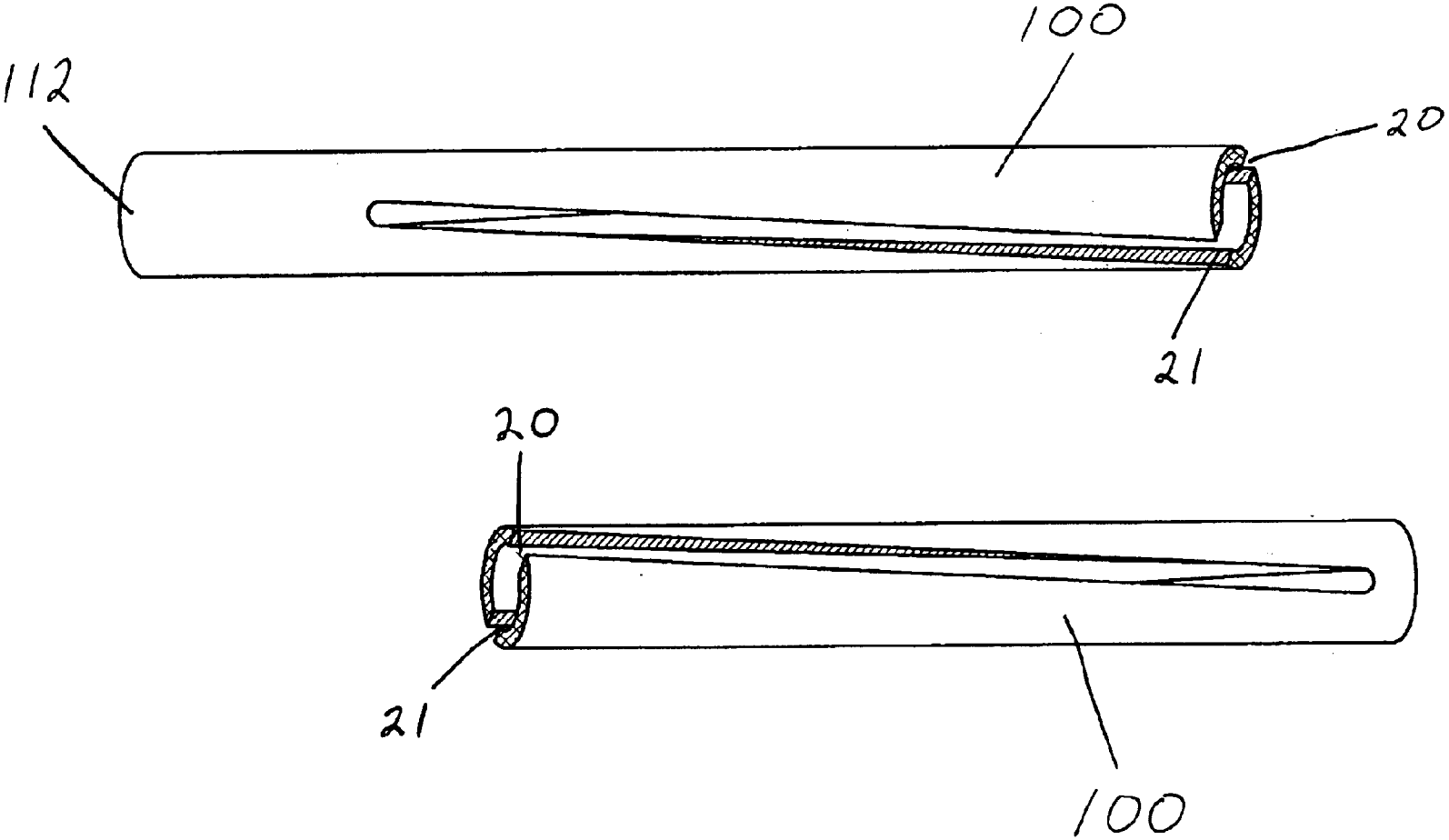
FIG. 2 is a perspective view of the helically slotted, diametrically opposed spin tube.
Figure 4:
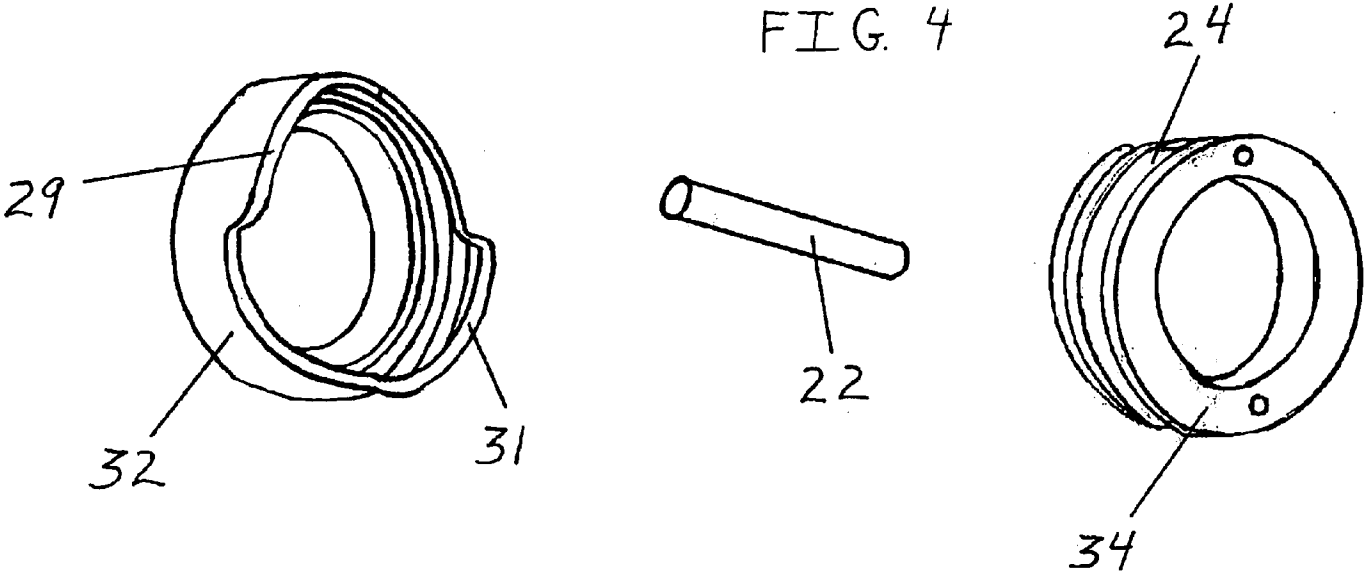
FIG. 4 is an exploded isometric view of the three piece helically slotted, diametrically opposed nock drive collar assembly viewed from the rear.
Figure 3:
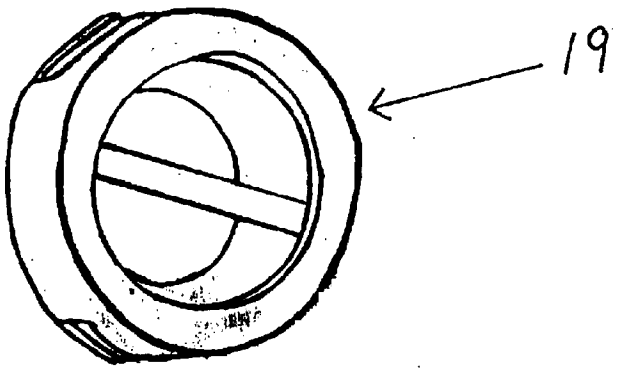
FIG. 3 is an assembled isometric view of the nock drive collar assembly viewed from the front.

FIG. 2 solely discloses the diametrically opposed, helically slotted spin tube or spin tube 100, sectioned with middle region removed allowing a larger view. Spin tube 100 is a single piece, hollow rigid body containing two diametrically opposed helical slots 20,21, located about the spin tube longitudinal axis. Helical slots 20,21 follow any desirable constant or variable pitch along the spin tube major axis. Helical slots 20,21 do not continue to the spin tube absolute ends. For structural rigidity, material remains intact at both ends of the spin tube, particularly at the front 112 where spin tube mounting occurs. Spin tube 100 is preferably made from one or more materials exhibiting the following properties: rigidity, low-weight, and resistance to the elements that an archery bow would typically encounter. More obvious material options include aluminum, thin walled steel, fiberglass or other composite material, or any hybrid combination of these materials.

FIGS. 3, 4, 5, 6, 7 detail views of the external nock drive collar assembly 19 for use with diametrically opposed, helically slotted spin tube or spin tube 100. External nock drive collar assembly 19 comprises three parts. The three parts are nock pin 22, nock drive collar male 34, and nock drive collar female 32. Male collar 34 threads into female collar 32. Captured within the two collar components is the nock pin 22. The nock pin freely rotates radially when captured within the nock drive collar halves 32 and 34. An arrow nock 116 connects to nock pin 22 in a manner similar to an arrow nock 116 connecting to a bowstring 114, the prior art. Thus, prior art arrows and nocks can be used with the present invention with no modifications. Located on the female nock drive collar 32 are two ears 29 and 31 (also visible in FIG. 1). The purpose of ears 29,31 is to capture bowstring 114 in circumferential slot 24 on the female nock drive collar 34. When the two nock collar halves are fully assembled, bowstring 114 remains captured within nock collar assembly 19 regardless of dynamic situations upon bowstring draw and release. Ultimately, the main goal of this assembly is to connect bowstring 114 to nock collar 19 externally located on spin tube 100 and connect to an arrow nock 116, inside the tube. Nock pin 22, housed within nock drive collar assembly 19 follows the diametrically opposed helical slots 20,21 (FIGS. 1, 2, 4) and radially rotates as nock collar 19 translates along spin tube 100. The net result is arrow rotation at a rate equaling the constant or variable helical pitch upon release (and draw) of the bowstring by an archer.

Figure 8:
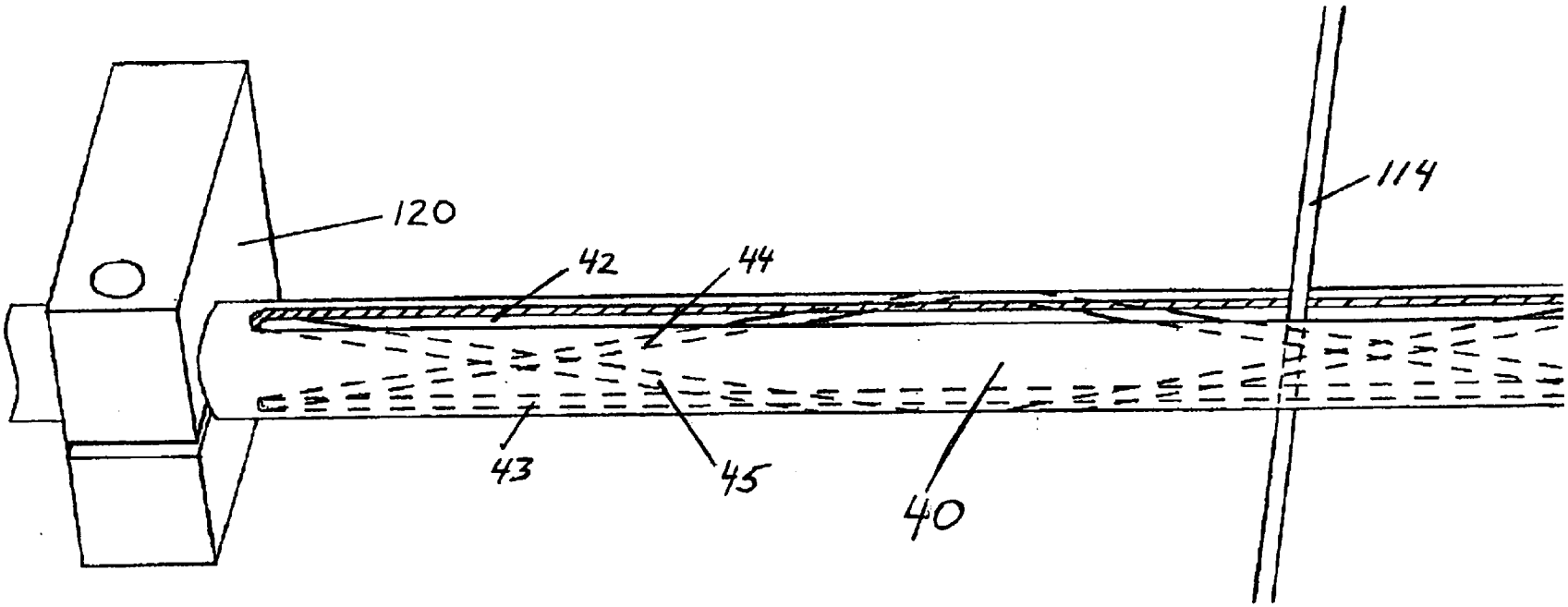
FIG. 8 details an alternative, internally "rifled" spin tube exhibiting diametrically opposed, straight-cut string slot. Note: internal nock drive collar assembly not shown in this view.
Figure 9:
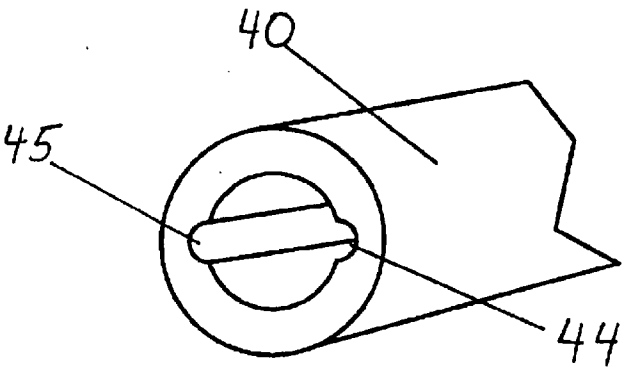
FIG. 9 is an isometric front view of the internally "rifled" spin tube.
Figure 10:
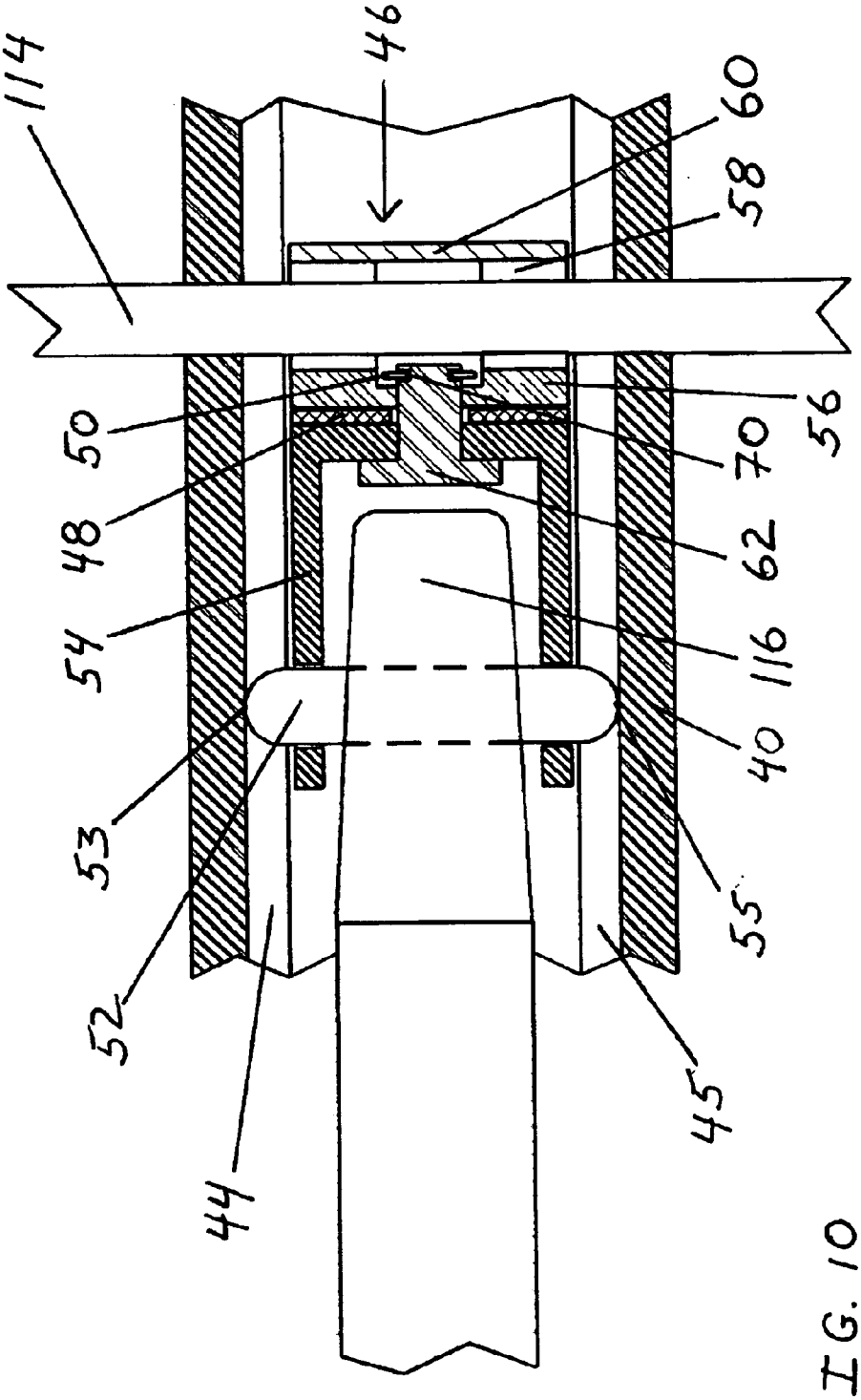
FIG. 10 details a sectional side view of the internally "rifled" spin tube with nock drive collar assembly installed internally. Also shown are bowstring and arrow nock interface to the assembly.
Figure 11:
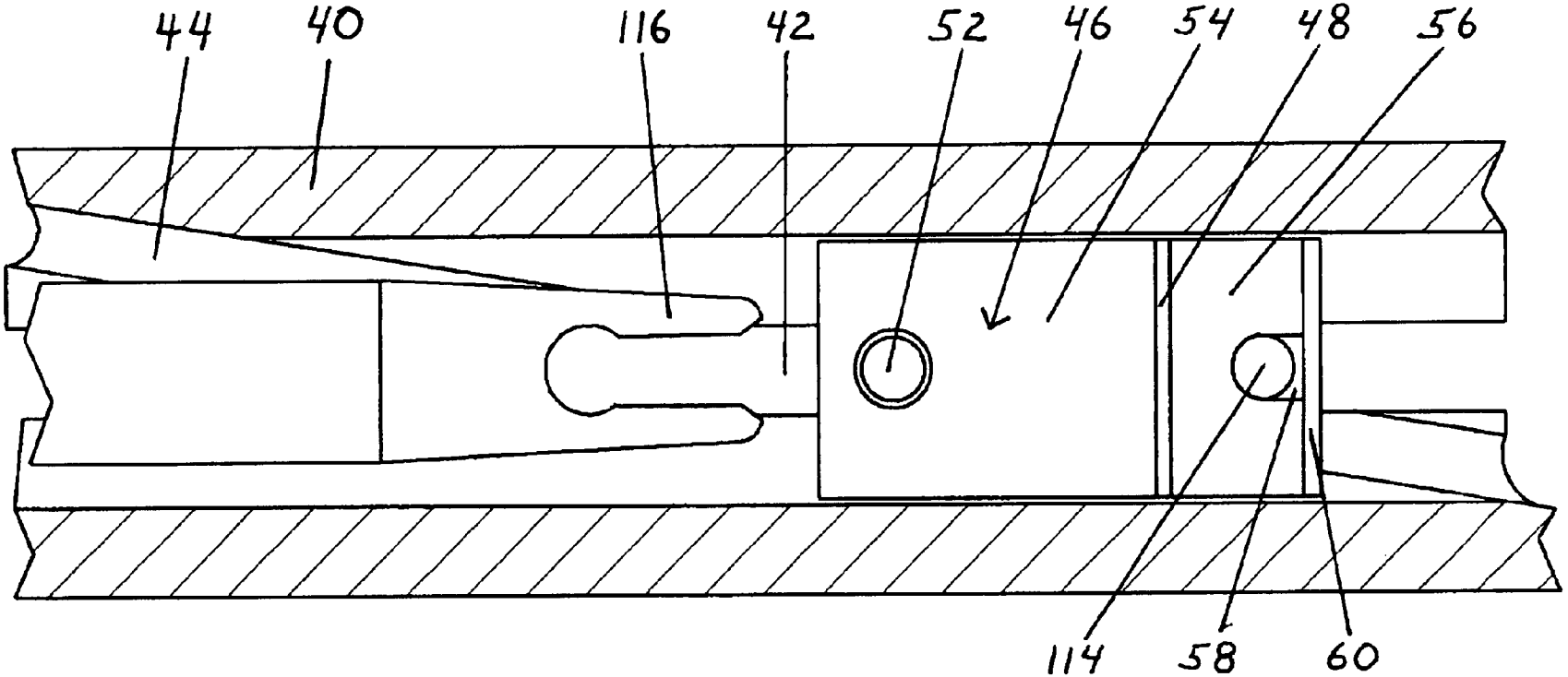
FIG. 11 details a top view of the internally "rifled" spin tube nock drive collar assembly situated within sectioned spin tube. An arrow nock is shown oriented to be offered up to the rotatable nock drive pin.
Figure 12:
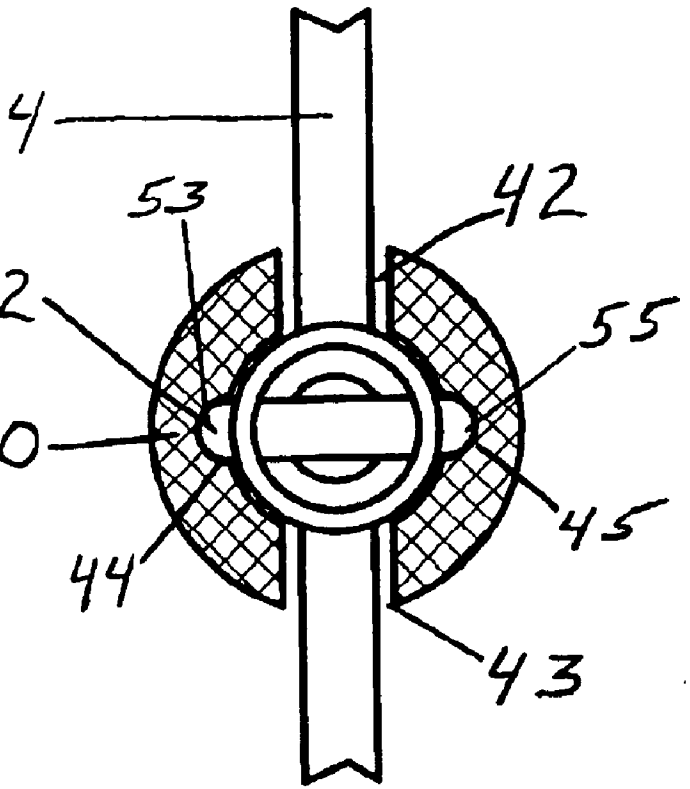
FIG. 12 is a sectional front view of the internally "rifled" spin tube detailing nock drive collar assembly and bowstring orientations.
Figure 13:
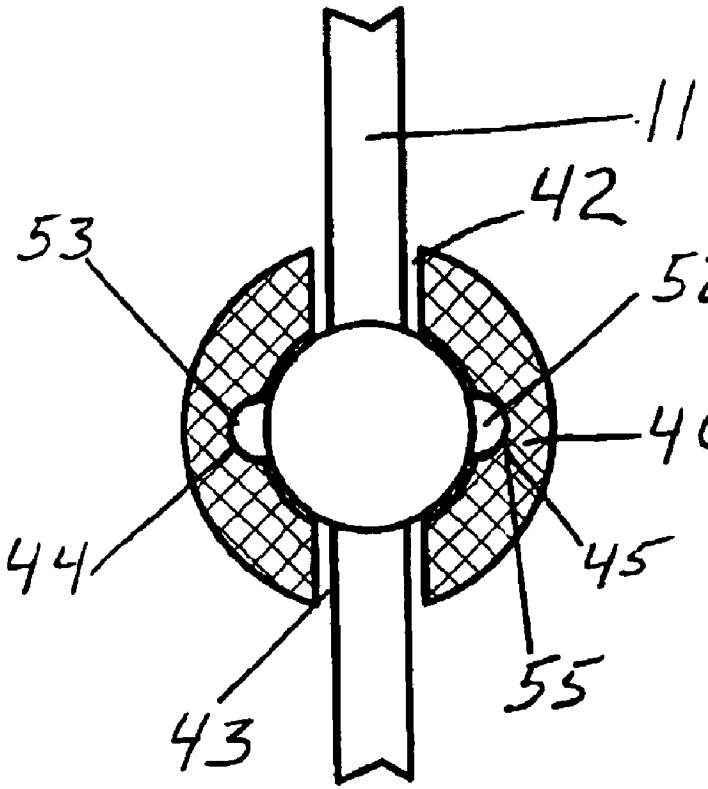
FIG. 13 is a sectional rear view of the internally "rifled" spin tube detailing captured bowstring in nock drive collar assembly.

FIGS. 8, 9 detail an alternative internally "threaded" spin tube 40 exhibiting diametrically opposed straight-cut slots or string slots 42,43 (also visible in FIGS. 11, 12, 13) piercing through both sides of spin tube 41, one hundred-eighty degrees apart. Bowstring 114 passes through string slots 42,43 for all ranges of bowstring draw and release. Spin tube 40 rigidly mounts to bow riser 110 (visible in FIG. 1) in a similar method as the helical spin tube discussed prior. Additionally, spin tube 40 and prior discussed spin tube 100 (FIGS. 1, 2) are the same length. Located on the inner bore of spin tube 40 are diametrically opposed constant or variable pitched helical grooves or rifling 44,45 as is seen by dashed lines on spin tube 40. Elaborated in the following paragraph is the internal nock drive collar 46 (FIGS. 10, 11, 12, 13) that freely translates within spin tube 40.

FIGS. 10, 11, 12, 13 detail the internal nock drive collar assembly 46 that resides within spin tube 40. Nock drive collar assembly 46 comprises two major parts. These major parts are the rotator 54 and driver 56. Sandwiched between rotator 54 and driver 56 is a bushing 48 made of low friction material such as ptfe. Rotator 54 and driver 56 connect about their centers by pin 62. Slot 70 retains pin 62 utilizing common available hardware such as an external snap-ring 50. An arrow nock 116 connects with internal nock pin 52. Internal nock pin 52 features radiused ends 53,55 that follow internal, helical, diametrically opposed grooves or rifling 44,45 located within spin tube 40. Rotator 54, in turn, rotates within spin tube 40 as driver 56 translates within spin tube 40 as an archer releases (and draws) bowstring 114. Driver 56 captures bowstring 114 in housing 58, capped off on the aft end by cap 60. Within housing 58 is a bore large enough for bowstring 114 to pass through. Captured bowstring 114 slidably rides within housing 58 allowing a string "floating" effect as an archer draws and releases bowstring 114.

Figure 14:
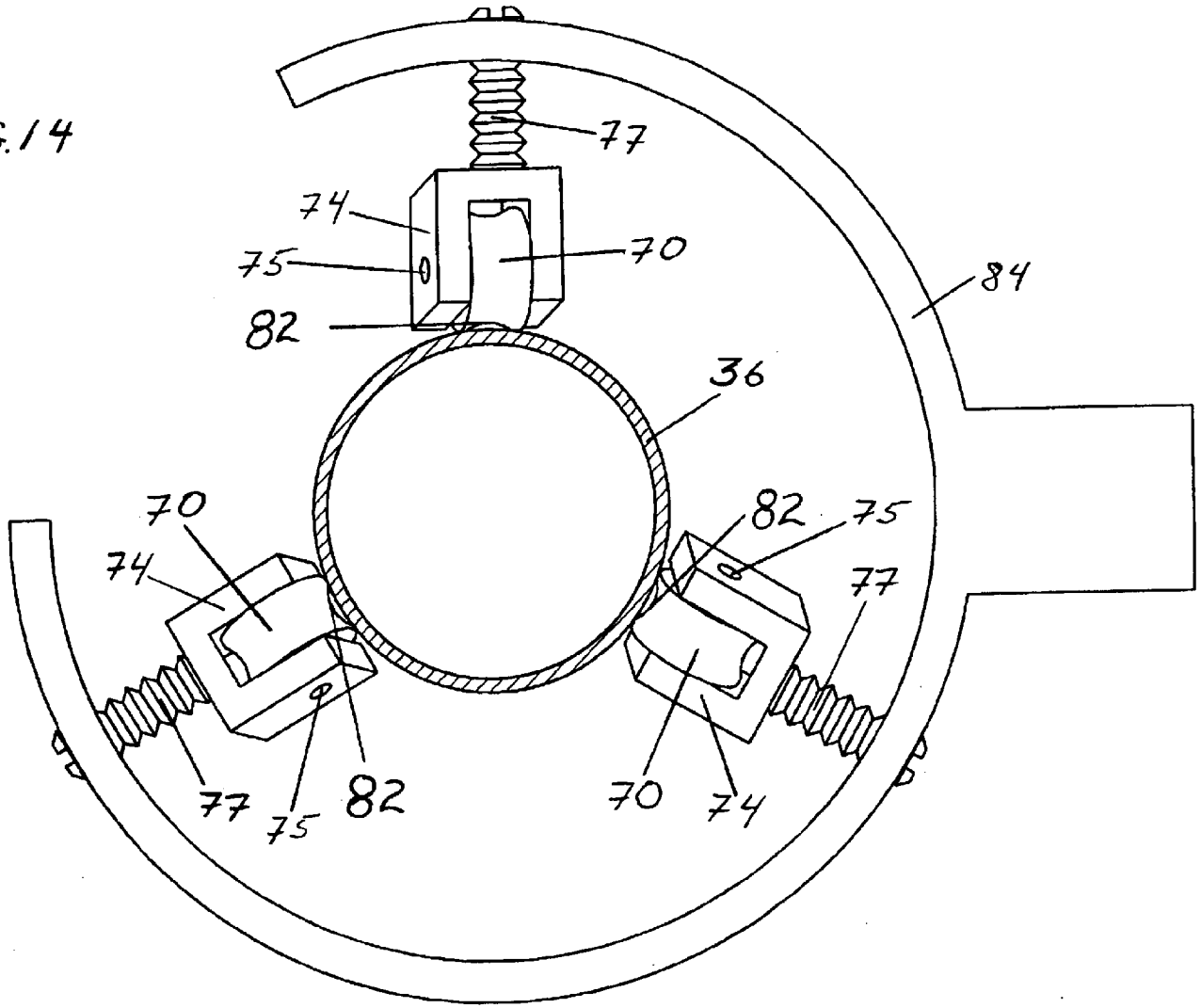
FIG. 14 details a rear view of deformable plurality, contact wheel, arrow shaft rotator assembly.

FIG. 14 is a detailed rear view of another method to mechanically induce arrow rotation during bowstring release through a plurality of deformable wheel arrow shaft rotators or wheels 70. Supported within a substantially circular tube 84 is arrow shaft 36, shown sectioned. Tube 84 mounts to a bow riser 110 (visible in FIG. 1) in the same location as traditional arrow rests. Wheels 70 can be of a single deformable material or composed of multi-durometer compounds within the same wheel. Each wheel 70 has a radiused face 82 that approximates the radius of an arrow shaft 36. Retained by a threadably connected mount 77, each wheel 70 threads into tube 84. Flanges 74 protrude from the ends of each mount 77 and retain a wheel axle 75. Incredible flexibility and tuning features are available by varying wheel durometer, angle of offset from the arrow axis, and wheel face radius 82.

Figure 15A:
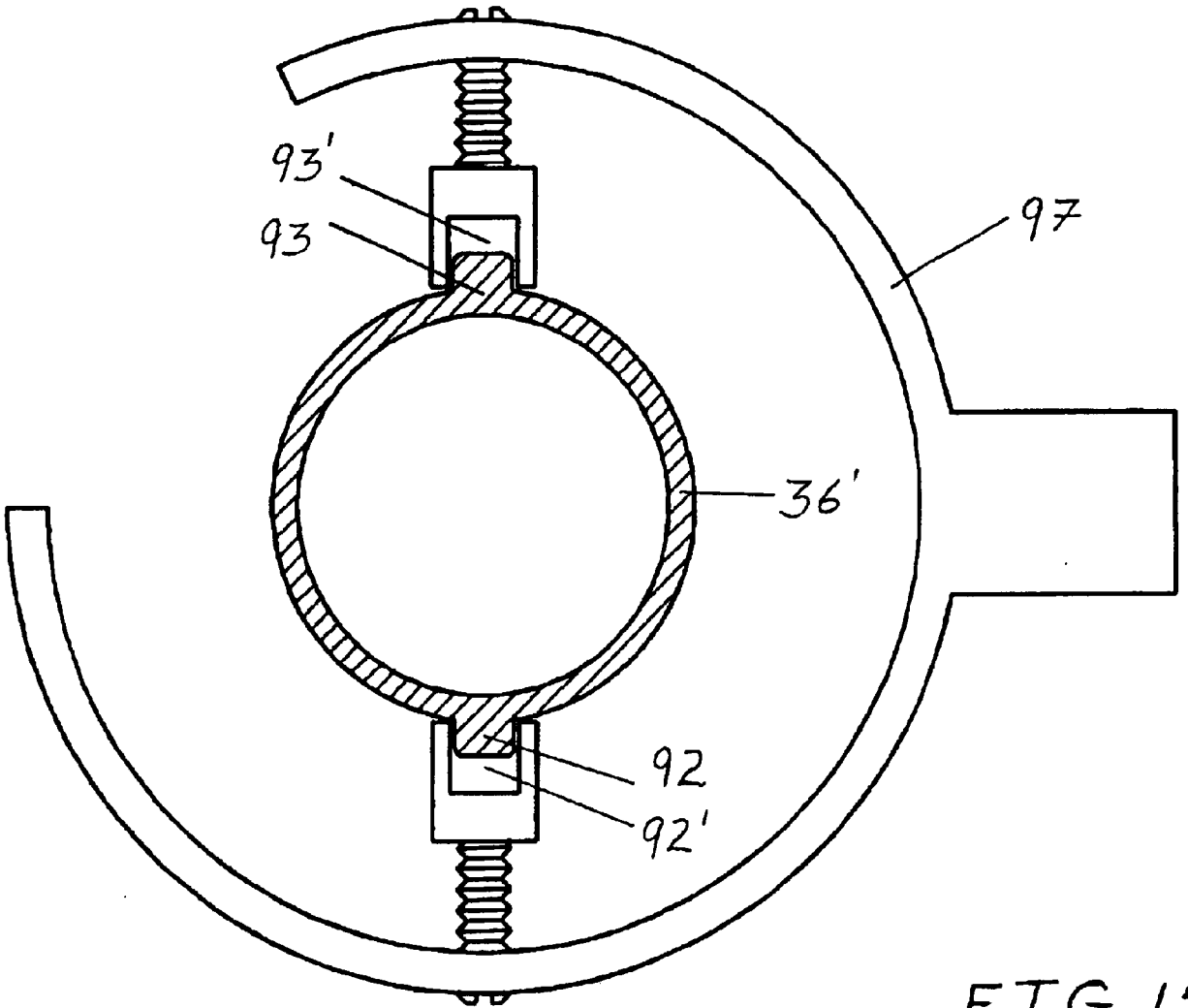
FIGS. 15(A,B) respectively, detail two corresponding species of helically ridged (A) or helically grooved (B) riser-mounted follower methods for contacting a helically ridged or grooved arrow shaft. Arrow shafts shown in sectional view.
Figure 15B:
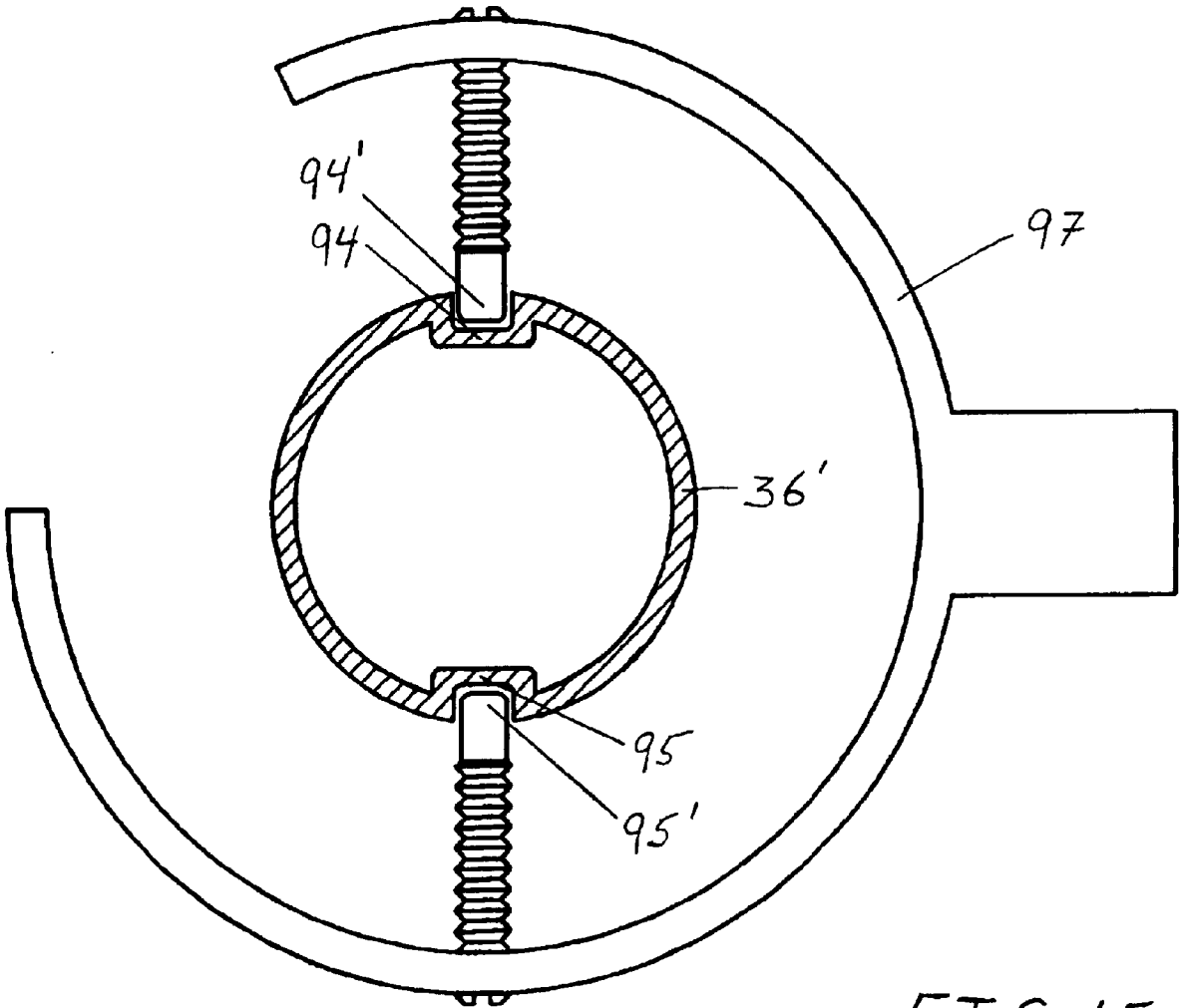

FIGS. 15 (A,B) schematically illustrate another enabling method of accomplishing arrow shaft rotation upon bowstring release. Arrow shaft 36' features at least two diametrically opposed helical ridges 92,93 that run some or all of the arrow 36' longitudinal axis. Ridges 92 and 93 can resemble any shape as long as the shape matches collar guides 92',93'. Follower frame 97 rigidly mounts to bow riser 110 (visible in FIG. 1) in the same location as a prior art arrow rest. As arrow 36' is drawn or released by an archer, arrow ridges 92,93 follow collar guides 92',93'. The shape collar guides 92',93' and ridges 92,93 can take offer incredible flexibility including making either set protrude or recess. A recessed species of helical grooves 94,95 is detailed in FIG. 17B. Recessed followers 94',95' match the shape of arrow grooves 94,95. Strategically designed, including a tapered leading edge, ridges 92,93 or grooves 94,95 can provide double service to an arrow. First, to mechanically contact followers 92',93',94,95 and second, to essentially act in a manner similar to fletching that runs at least a portion of an arrow 36' longitudinal axis.

Although numerous embodiments are described, they are merely exemplary of the invention and are not to be construed as limiting, the invention being defined solely by the scope and spirit of the appended claims.

We claim:

1. An arrow rotation device for archery bows, particularly for mechanically inducing rotation on an arrow longitudinal axis during the releasing range from a bow and prior to free flight of the arrow consisting of a spin tube affixed to the bow through which an arrow can travel upon being released, and one or more longitudinal helical grooves in the wall of the spin tube, and a nock drive collar assembly able to freely translate along the spin tube longitudinal axis operatively connecting a nock drive pin, whereby the nock drive pin is capable of following the helical grooves such that the nock pin is forced to rotate when translating along the longitudinal axis of the spin tube and a means of operatively connecting the bowstring with said nock drive collar.

2. The arrow rotation device according to claim 1, wherein said longitudinal helical grooves pass completely through said spin tube structural wall throughout the releasing range and said nock drive collar assembly is located external to said spin tube.

3. The arrow rotation device according to claim 2, wherein said longitudinal helical grooves comprise a variable helical pitch.

4. The arrow rotation device according to claim 2, wherein said longitudinal helical grooves comprise a constant helical pitch.

5. The arrow rotation device according to claim 1, wherein said longitudinal helical grooves cut only partially into the internal wall of said spin tube with a linear string slot passing through the spin tube throughout the releasing range and said nock drive collar assembly located within said spin tube.

6. The arrow rotation device according to claim 5, wherein said longitudinal helical grooves comprise a variable helical pitch.

7. The arrow rotation device according to claim 5, wherein said longitudinal helical grooves comprise a constant helical pitch.

8. A method of inducing rotation on an arrow shaft prior to release from a bow, comprising the steps of:

providing a bow having a bowstring operatively connected to a nock drive assembly, riser, limbs, tube;

providing a mount for said tube to said bow;

longitudinally providing a helical guide along said tube for the usable range of string travel;

providing an operative connection for a conventional arrow to engage said nock drive collar assembly;

providing an operative connection for at least part of said nock drive collar assembly to follow said helical guide on said spin tube.

9. The method of claim 8 wherein the step of operatively connecting said bowstring to said nock drive collar is by said bowstring being captured in said nock drive collar assembly and;

said at least part of nock drive collar assembly following said helical guide by free rotation about the assembly fore and aft components.

* * * * *